US005250129A

United States Patent [19]

Twele

[11] Patent Number: 5,250,129

[45] Date of Patent: Oct. 5, 1993

[54] APPARATUS FOR APPLYING HEAT SENSITIVE LABELS AND PRESSURE SENSITIVE LABELS

[75] Inventor: Terrance J. Twele, Toledo, Ohio

[73] Assignee: Owens-Illinois Plastic Products Inc., Toledo, Ohio

[21] Appl. No.: 694,183

[22] Filed: May 1, 1991

[51] Int. Cl.[5] ..... B65C 1/00

[52] U.S. Cl. ..... 156/64; 156/235; 156/238; 156/247; 156/361; 156/542

[58] Field of Search ..... 156/540, 541, 542, 360, 156/361, 230, 235, 238, 247, 64

[56] References Cited

U.S. PATENT DOCUMENTS

| | | | |
|---|---|---|---|
| 4,019,935 | 4/1977 | Harvey | 156/64 |
| 4,381,211 | 4/1983 | Nechay | 156/361 |
| 4,452,659 | 6/1984 | Geurtsen et al. | 156/361 |
| 4,735,664 | 4/1988 | Asghar et al. | 156/64 |
| 4,855,005 | 8/1989 | Jodrey | 156/361 |

*Primary Examiner*—David A. Simmons

*Assistant Examiner*—J. Sells

[57] ABSTRACT

An apparatus for applying heat sensitive labels and pressure sensitive labels wherein the apparatus can be readily changed to apply heat sensitive labels or pressure sensitive labels from a web along which the labels are positioned. In one mode for applying heat sensitive labels, the web is moved from a feed reel over a shuttle mechanism, a metering mechanism and adjacent a preheater and to a platen where successive labels are contact transferred from the web and applied to successive containers on a turret and thereafter the web is stored on a take-up reel. In a second mode, the preheater and platen are removed, the shuttle mechanism is bypassed, a peel bar assembly is positioned in place of the platen, a driven web take-up mechanism is added in advance of the take-up reel, and pressure hold down rolls are provided on the metering mechanism and the web with the labels thereon is moved about the peel bar assembly to peel a label from the web and apply the pressure sensitive label to an article on the turret and the web is thereafter redirected to the take-up reel.

7 Claims, 3 Drawing Sheets

APPARATUS FOR APPLYING HEAT SENSITIVE LABELS AND PRESSURE SENSITIVE LABELS

This invention relates to applying labels to articles and particularly applying labels to articles by removal of the labels from a web upon which they are stored and application thereof to the articles.

BACKGROUND AND SUMMARY OF THE INVENTION

In the application of labels by what is known as transfer labeling, it is customary to position labels on a web and thereafter transfer the labels to the article to be labeled. In one type of such labeling, heat sensitive labels are used which must be heated and applied to the articles. In another type, pressure sensitive labels are used which must be removed from the web and applied to the article. Heretofore, it has been common to have separate apparatus for handling each of these types of labels.

Among the objectives of the present invention are to provide a method and apparatus for having one apparatus that can be readily changed for usage either for applying heat sensitive labels or for applying pressure sensitive labels; which apparatus utilizes the basic mechanism heretofore available for heat sensitive labels and conversion mechanisms such that the apparatus can be readily used in applying pressure sensitive labels; which involves a minimal change; wherein the additional mechanisms are relatively low in cost compared with having a separate apparatus for applying pressure sensitive labels; and wherein the change from one mode to another is readily achieved.

In accordance with the invention, the apparatus for applying heat sensitive labels and pressure sensitive labels wherein the apparatus can be readily changed to apply heat sensitive labels or pressure sensitive labels from a web along which the labels are positioned comprises apparatus. In one mode for applying heat sensitive labels, the web is moved from a feed reel over a shuttle mechanism, a metering mechanism and adjacent a preheater and to a platen wherein successive labels are contact transferred from the web and applied to successive containers on a turret and thereafter the web is stored on a take-up reel. In a second mode, the preheater and platen are removed, the shuttle mechanism is bypassed and a peel bar assembly is positioned in place of the platen and the web with the labels thereon is moved about the peel bar assembly to peel a label from the web and apply the pressure sensitive label to a article on the turret and the web is thereafter redirected to the take-up reel.

More specifically, the invention provides for to the interchangeable conversion between a heat sensitive mode for applying heat sensitive labels and a pressure sensitive mode for applying pressure sensitive labels utilizing a currently available apparatus for applying heat sensitive labels. Such apparatus includes a feed reel having a web with heat sensitive labels is provided to supply the web around a metering wall, then over a dancer roll, over a shuttle that reciprocates to change the direction of movement of the labels for controlling the web and over a preheat assembly to a platen that is movable into and out of position for applying the heated label to an article on a turret. Such an apparatus further includes a take-up shuttle roll, and an idler roll directing the web to a take-up reel. The supply of the web by the feed reel is determined by the metering wall and the take up of web by the reel is continuous while the motion of individual labels varies by a label shuttle mechanism. In accordance with the invention, in order to convert the apparatus to the application of pressure sensitive labels, the preheater platen and cam drum for moving platen into and out of position are removed, the shuttle mechanism is bypassed and a peel bar assembly is positioned adjacent the articles, a driven web take-up mechanism is added in advance of the take-up reel, and pressure hold down rolls are provided on the metering mechanism.

DESCRIPTION

In accordance with the invention, the basic apparatus for applying heat sensitive labels is utilized for applying pressure sensitive labels wherein the apparatus can be readily changed to apply heat sensitive labels or pressure sensitive labels from a web along which the labels are positioned. In one mode for applying heat sensitive labels, the web is moved from a feed reel over a shuttle mechanism, a metering mechanism and adjacent a preheater and to a platen where successive labels are applied directly from the web to successive non-rotating oval containers on a turret and thereafter the web is stored on a take-up reel. In a second mode, the preheater and platen are removed, the shuttle mechanism is bypassed and a peel bar assembly is positioned in place of the platen and the web with the labels thereon is moved about the peel bar assembly to peel a label from the web and apply the pressure sensitive label to a article on the turret and the web is thereafter redirected to the take-up reel.

Figure 1:
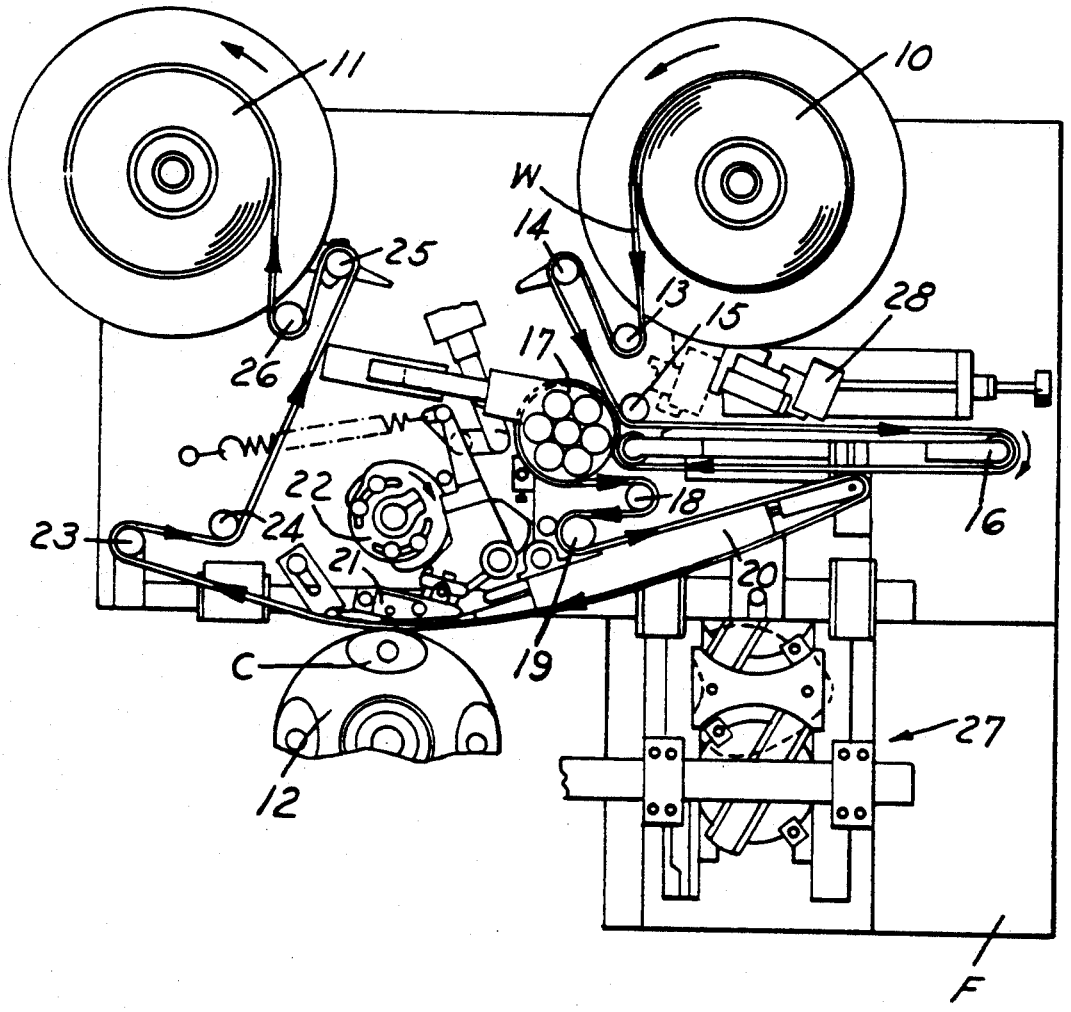
FIG. 1 PRIOR ART
FIG. 1 is a schematic diagram of a prior art mechanism for applying heat sensitive labels.

Referring to FIG. 1, the conventional apparatus for applying heat sensitive labels comprises a frame F which supports a feed reel 10 for a web having heat sensitive labels thereon. The web passes under an idler roller 13, over an idler roller 14, under an idler roller 15 and a shuttle mechanism 16 having rollers thereon. The web thereafter passes thereafter over a metering mechanism 17 and rollers 18, 19 beneath a preheater 20 to a platen 21 that is reciprocated by cam drum 22 into and out of position to apply pressure on the web W and pressing the label against an article C which comprises one of a plurality of articles such as containers on a turret 12. The web then passes over idler rollers 23, 24, 25, 26 and is wound on a take-up reel 11. The supply of the web by the feed reel 10 and the take-up of the web by the take-up reel 11 is continuous while the motion of the individual labels varies to register the pressure sensitive labels with the articles.

Figure 2:
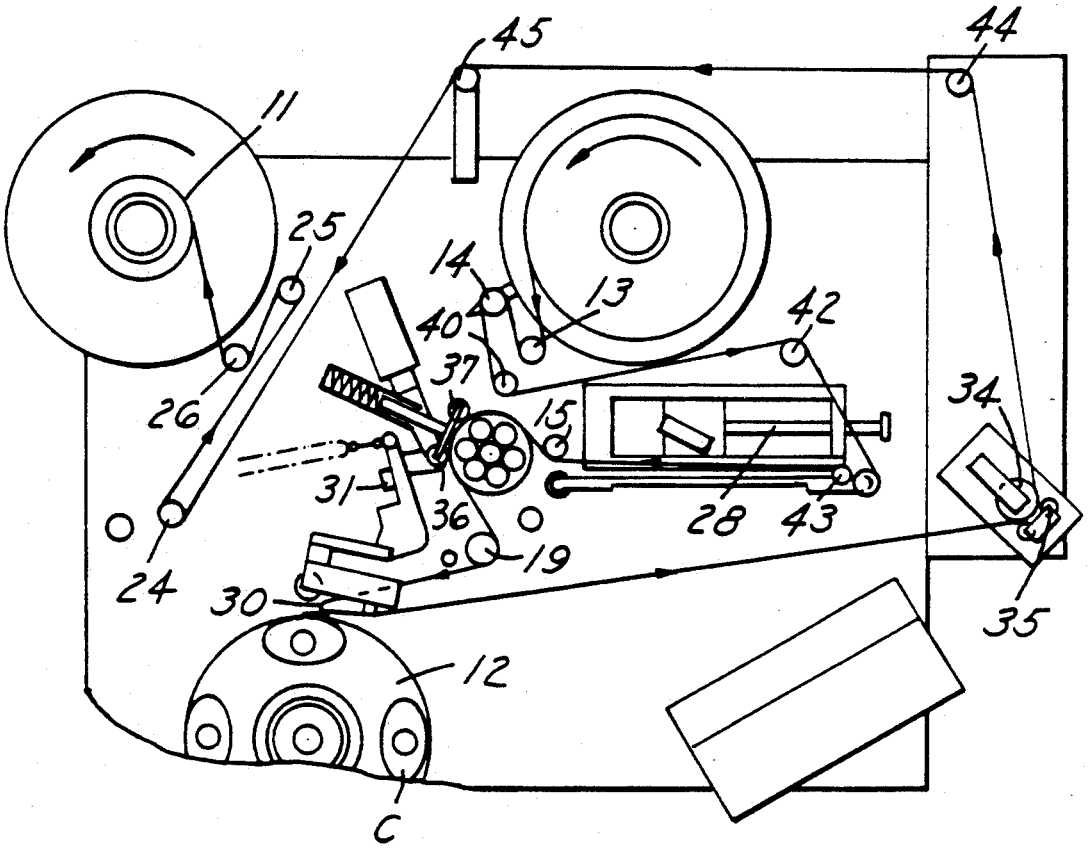
FIG. 2 is a schematic diagram showing the apparatus as it is converted for application of pressure sensitive labels.

Referring to FIG. 2 which is a schematic view of the apparatus converted to apply pressure sensitive labels, in order to convert the apparatus, the preheater 20, platen 21 and cam drum 22 are removed from the frame. A peel bar assembly 30 is provided, and a stop 31 is provided to hold the prior peel bar support out of position. In addition, a driven web take-up mechanism 33 is provided in advance of the take-up reel 11. Take-up mechanism 33 comprises a power driven resilient roll 35 to pull the web toward the take-up reel 11. Rolls 36, 37 are yieldingly urged against the drum of the metering mechanism 17 to hold the web against the drum without slipping. Rollers 40, 41, 43, 44 and 45 are added. Thus, the web bearing the pressure sensitive labels is trained about the rollers 13, 14, 40, 41, 42, 43, 15, and between metering roll 17 and rolls 36, 37, and roller 19, over the peel bar assembly 30 where the change in direction of the web strips each label so that it can be applied to the articles C on the turret 12. All reciprocating movement is eliminated so that the web after leaving the peel bar assembly 30 passes between rollers 34 and 35 of the take-up drive mechanism 33 and then about idler rollers 44, 45 and over the the idler rollers 24, 25, 26 to the take-up reel 11.

It can be seen that the roller 44 is mounted on the same housing 42 that supports the conventional photosensor 28 for controlling registration of the label as is well known in the art.

Figure 3:
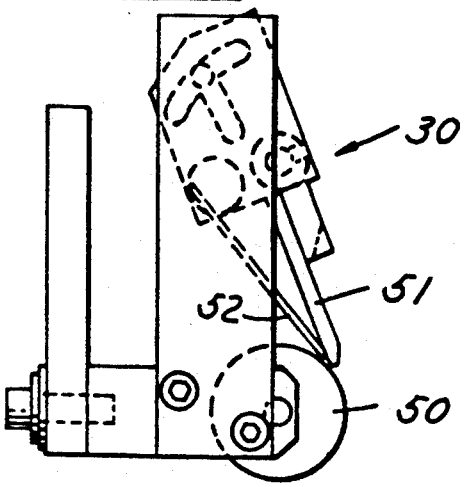
FIG. 3 is a side view of the peel bar assembly.
Figure 4:
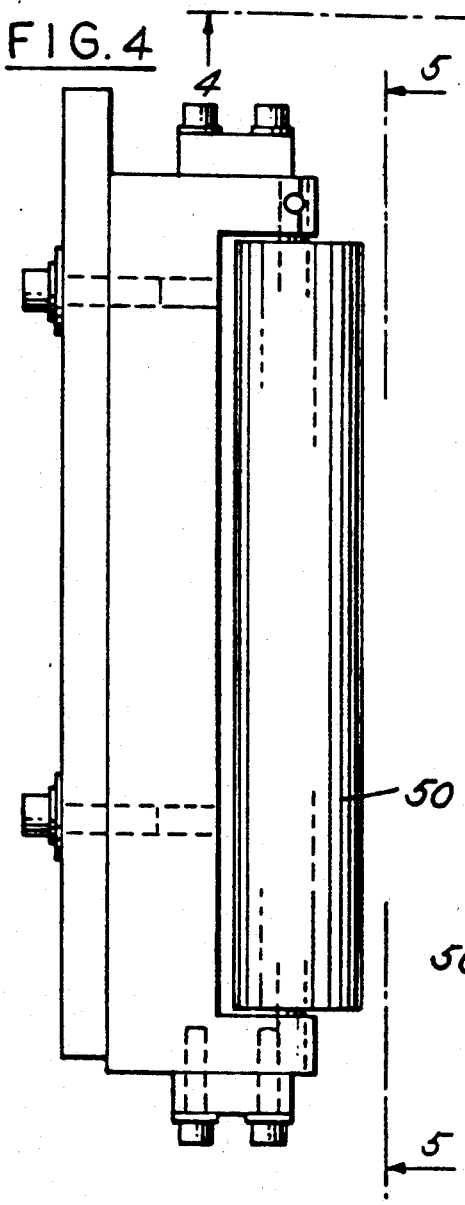
FIG. 4 is a sectional view taken along the line 3—3 in FIG. 3.
Figure 5:
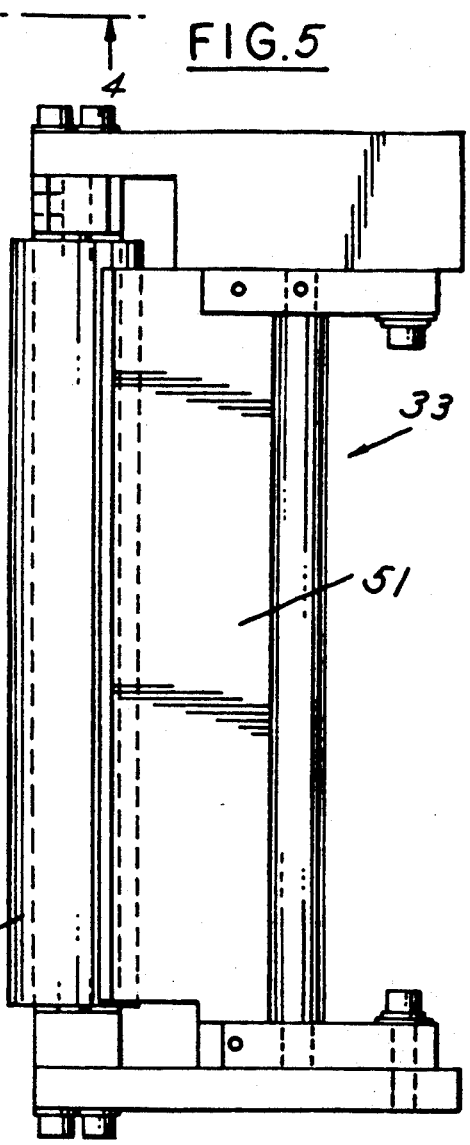
FIG. 5 is a sectional view taken along the line 4—4 in FIG. 4.

Referring to FIGS. 3–5, the peel bar assembly 30 includes an idler roller 50 and a peel blade or platen 51. As the web with the pressure sensitive label approaches the peel blade 51, it passes between the peel blade 51 and the roller 50 and past the tip of the platen 51 so that the web changes direction and the label is peeled from the web. A flat spring 52 provides friction tension on the label and causes it to curl toward the roller 50.

In operation, the sensors normally utilized on the turret 12 are utilized to control the feed of the web by activating the clutch on the metering roll and disengaging a brake thereon.

It can thus be seen that there has been provided a method and apparatus for applying heat sensitive labels and pressure sensitive labels wherein the apparatus can be readily changed to apply heat sensitive labels or pressure sensitive labels from a web along which the labels are positioned. In one mode for applying heat sensitive labels, the web is moved from a feed reel over a shuttle mechanism, a metering mechanism and adjacent a preheater and to a platen where successive labels are applied directly from the web to successive containers on a turret and thereafter the web is stored on a take-up reel. In a second mode, the preheater and platen are removed, the shuttle mechanism is bypassed and a peel bar assembly is positioned in place of the platen, a driven web take-up mechanism is added in advance of the take-up reel, and pressure hold down rolls are provided on the metering mechanism and the web with the labels thereon is moved about the peel bar assembly to peel a label from the web and apply the pressure sensitive label to an article on the turret and the web is thereafter redirected to the take-up reel.

It can thus be seen that there has been provided a method and apparatus for having one apparatus that can be readily changed for usage either for applying heat sensitive labels or for applying pressure sensitive labels; which apparatus utilizes the basic mechanism heretofore available for heat sensitive labels and conversion mechanisms such that the apparatus can be readily used in applying pressure sensitive labels; which involves a minimal change; wherein the additional mechanisms are relatively low in cost compared with having a separate apparatus for applying pressure sensitive labels; and wherein the change from one mode to another is readily achieved.

I claim:

1. The method of utilizing an apparatus for applying heat sensitive labels to a container to apply pressure sensitive labels wherein the apparatus applying heat sensitive labels includes a web on which the heat sensitive labels are moved from a feed reel over a shuttle mechanism, a metering mechanism and adjacent a preheater and to a platen where successive labels are applied directly from the web to successive containers on a turret and thereafter the web is stored on a take-up reel, which method comprises removing the preheater and platen, bypassing the web from the shuttle mechanism, positioning a peel bar assembly in place of the platen, providing means in advance of the take-up reel for moving the web with the pressure sensitive labels thereon about the peel bar assembly to peel a label from the web, applying the pressure sensitive label to an article on the turret, and providing means for redirecting the web to a take-up reel.

2. The method set forth in claim 1 including providing a pair of relatively moveable rollers for urging the web against the metering mechanism as it moves to the peel bar assembly.

3. The method set forth in claim 2 including the step of providing a resilient force on said rollers.

4. An apparatus which can be used for applying heat sensitive labels or applying pressure sensitive labels wherein the apparatus applying heat sensitive labels comprises a feed reel from which a web of heat sensitive labels can be moved from said feel reel, a preheater, a platen where successive labels are applied by pressure directly from the web to successive containers on a turret, a shuttle mechanism for synchronizing motion of the web to motion of the containers on the turret in a pressure sensitive labeling mode of operation, and a take-up reel wherein the web is stored, said preheater and platen being removable, a peel bar assembly adapted to be positioned in place of the platen in a pressure sensitive labeling mode of operation, first additional means for moving the web with the pressure sensitive labels thereon about the peel bar assembly bypassing the shuttle mechanism to peel a label from the web, and apply the pressure sensitive label to an article on the turret, and second additional means for redirecting the web bypassing the shuttle mechanism to a take-up reel in said pressure sensitive labeling mode of operation.

5. The apparatus set forth in claim 4 including a roller assembly adapted to be removably mounted in the path of the web as it is passed over a metering roll in said pressure sensitive labeling mode of operation.

6. The apparatus set forth in claim 5 wherein said roller assembly includes a pair of rollers angularly spaced from each other around the metering roll, and means for urging said pair of rollers in unison against the metering roll.

7. The method set forth in claim 1 wherein said step of providing means in advance of the take-up reel for moving the web about the peel bar assembly comprises the step of applying tension to the web in advance of said take-up reel as the web transverses the peel bar assembly to enhance separation of the labels from the web.

* * * * *